US005281193A

United States Patent [19]

Colbo, Jr.

[11] Patent Number: 5,281,193

[45] Date of Patent: Jan. 25, 1994

[54] BENCH-PRESS WEIGHT WORKOUT STATION WITH SAFETY FEATURES

[76] Inventor: Kenneth G. Colbo, Jr., 2001 S. Russell, Missouli, Mont. 59801

[21] Appl. No.: 870,413

[22] Filed: Apr. 17, 1992

[51] Int. Cl.[5] ..... A63B 21/078

[52] U.S. Cl. ..... 482/104; 482/142; 482/908

[58] Field of Search ..... 482/97-108, 482/133-138, 144-145, 908, 142

[56] References Cited

U.S. PATENT DOCUMENTS

| | | | |
|---|---|---|---|
| 3,874,658 | 4/1975 | Flowers . | |
| 4,098,502 | 7/1978 | Faust | 482/104 |
| 4,216,959 | 8/1980 | Niles . | |
| 4,249,726 | 2/1981 | Faust . | |
| 4,316,609 | 2/1982 | Silberman . | |
| 4,382,596 | 5/1983 | Silberman . | |
| 4,396,191 | 8/1983 | Metler . | |
| 4,411,425 | 10/1983 | Milnar . | |
| 4,474,370 | 10/1984 | Oman . | |
| 4,632,390 | 12/1986 | Richey . | |
| 4,635,930 | 1/1987 | Cormier . | |
| 4,641,837 | 2/1987 | Ruth . | |
| 4,653,751 | 3/1987 | Green . | |
| 4,669,724 | 6/1987 | Matheisen | 482/145 |
| 4,700,944 | 10/1987 | Sterba et al. . | |
| 4,750,739 | 6/1988 | Lange . | |
| 4,765,616 | 8/1988 | Wolff . | |
| 4,773,642 | 9/1988 | Cruz . | |
| 4,799,672 | 1/1989 | Barrett . | |
| 4,799,673 | 1/1989 | Selle . | |
| 4,807,875 | 2/1989 | Tanski . | |
| 4,826,157 | 5/1989 | Fitzpatrick | 482/103 X |
| 4,861,025 | 8/1989 | Rockwell . | |
| 4,919,419 | 4/1990 | Houston | 482/138 |
| 4,928,961 | 5/1990 | Madden . | |
| 4,953,857 | 9/1990 | Lemire . | |
| 4,960,277 | 10/1990 | LaRossa et al. . | |
| 5,108,354 | 4/1992 | Becker | 482/104 |
| 5,141,480 | 8/1992 | Lennox et al. | 482/104 |

FOREIGN PATENT DOCUMENTS

| | | |
|---|---|---|
| 1123025 | 5/1982 | Canada . |
| 2223181 | 9/1989 | United Kingdom . |

*Primary Examiner*—Robert Bahr
*Attorney, Agent, or Firm*—John R. Flanagan

[57] ABSTRACT

Bench-press and preacher-curl weight workout stations incorporate improved safety features to reduce the likelihood of injury to the weight lifter during the workouts. A bench assembly of the bench-press station has includes a platform and a base supporting the platform. The safety feature in the bench assembly is a platform height adjusting mechanism operable to permit one end of the platform to undergo pivotal movement from an upper position to a lower position relative to the base to where the body of the weight lifter is clear of the barbell so that the weight lifter can slide out from under the barbell and off the platform at the end of a workout session. A stand assembly of the preacher-curl station includes an elongated base and a support post attached to and extending upright from the base, and an elongated arm mounted above the base to the support post to undergo pivotal movement and extending outwardly in cantilevered fashion from the support post to an outer end supporting a shelf for holding a barbell. The safety feature in the stand assembly is a height adjusting mechanism operable to permit the elongated arm to undergo pivotal movement from a lower position to an upper position and thereby move the shelf from a start weight rest position to a finish weight rest position higher than the start position to where the barbell can be placed at the end of a workout session.

10 Claims, 4 Drawing Sheets

BENCH-PRESS WEIGHT WORKOUT STATION WITH SAFETY FEATURES

BACKGROUND OF THE INVENTION

1. Field of the Invention

The present invention generally relates to body building and exercising equipment and, more particularly, to bench-press and preacher-curl weight workout stations incorporating safety features designed to reduce the likelihood of injury to the weight lifter.

2. Description of the Prior Art

An increasingly popular form of weight lifting is the bench press. In a bench-press weight workout, the lifter lies with his or her back resting on a horizontal or declined bench (angled so that the head is lower than the knees). A barbell is raised from a rest position on the weight lifter's chest, to full extension of the arms, and then back to the chest again. It is important in the bench-press weight workout that the lifter be working near his or her maximum weight limit for several repetitions, and that, in each repetition, the lifter be able to lower the barbell down to the chest.

Normally, the weight lifter will raise the barbell from a support rack located above the lifter's head when the bench-press workout begins and return the barbell to the same support rack when finished so that the lifter can then easily exit the bench. However, if the weight lifter is unable to return the barbell to the support rack at the finish of the workout, then the barbell will remain on the lifter's chest, pinning the lifter to the bench and subjecting the lifter to potentially serious injury. Because of this risk, it is common practice to require additional persons to be present to act as spotters who can assist in raising a barbell off a trapped weight lifter before serious injury occurs.

In recent years, an increasing trend has been for many weight lifters to workout by themselves, particularly in a home environment. In recognition of this trend, a number of mechanical devices have been proposed in an attempt to protect the weight lifter and/or raise the barbell after a failed lift. Representative of the prior art devices are those disclosed in U.S. Pat. Nos. to Flowers (3,874,658), Niles (4,216,959), Faust (4,249,726), Milnar (4,411,425), Comier (4,635,930), Cruz (4,773,642), Barrett (4,799,672), Selle (4,799,673) and Tanski (4,807,875). Most of these prior art devices contain one or more shortcomings which make them less than an optimum solution to the problem of protecting the solo weight lifter from the consequences of a failed lift.

One shortcoming of some of the prior art devices is that they simply prevent the barbell from being lowered far enough during the workout to pin the weight lifter. These devices will also prevent a weight lifter from fully completing the downward movement which is generally deemed necessary for maximum workout. As a result, such safety devices are seldom used by serious weight lifters.

Another shortcoming of other prior art devices is that they require that the barbell be raised or pushed by the pinned weight lifter in order to remove the barbell from the lifter's chest to a position where the barbell can be safely held clear of the lifter. A weight lifter who is unable to complete the lift and becomes pinned by the barbell will have extremely limited ability or energy to maneuver the barbell to such a position.

In order to avoid such shortcomings while still enabling the barbell to be raised, some of the prior art devices have provided means for mechanically raising the barbell from a trapped or pinned weight lifter. However, such devices are complicated and expensive and require an external power source for operation.

With respect to equipment used by weight lifters in preacher-curl weight workouts, a problem exist that is comparable to that described above with respect to bench-press weight workouts. Weight lifters using a standard preacher-curl stand must reach below the chest platform to remove the barbell from a fixed bracket. This can be extremely uncomfortable and can cause overextension of the elbows and lower back area. Further, at the completion of the lifting repetitions, many weight lifters drop the barbell into the fixed bracket in order to avoid possible overtension injury. Dropping the barbell into the bracket not only can damage the equipment, but also increases the risk of injury to the weight lifter and to other persons in the immediate vicinity.

Consequently, a need exists for the design of improved safety features on bench-press and preacher-curl workout stations which will avoid the aforementioned problems and shortcomings.

SUMMARY OF THE INVENTION

The present invention provides weight workout stations with safety features designed to satisfy the aforementioned need. The workout stations of the present invention are used respectively in bench-press and preacher-curl weight workouts. The safety features are designed to reduce the likelihood of injury to the weight lifter during the workouts. The bench-press workout station has a bench assembly which incorporates the safety feature. The preacher-curl workout station has a stand assembly which incorporates the safety feature.

Accordingly, the present invention is directed to a bench assembly for a bench-press weight workout station. The bench assembly comprises: (a) an elongated base stationarily disposable on a support surface; (b) an elongated platform; (c) means for mounting the platform above the base and interconnected to the base to undergo reciprocal movement at one end of the platform toward and away from the base and to undergo pivotal movement at an opposite end of the platform about a transverse axis and relative to the base in order to raise and lower the one end of the platform relative to the base and thereby change the platform between first and second positions, the one end of the platform being lower at the second position of the platform than at the first position of the platform; and (d) a platform height adjusting mechanism connected to and extending between the base and the one end of the platform and being latchable to hold the platform at the first position relative to the base, unlatchable to release the platform and permit the platform to undergo pivotal movement from the first position to the second position, and latchable to hold the platform at the second position.

Also, the present invention is directed to a bench-press weight workout station which comprises the above-defined bench assembly and a weight support rack assembly. The support rack assembly is disposed adjacent to the one end of the platform of the bench assembly. The support rack assembly has a pair of support members each extending in a generally upright relation to the bench assembly and being disposed at one of a pair of opposite sides of the bench assembly adjacent to the one end thereof and a pair of support arms each mounted at one end to one of the upright support members and extending in a generally transverse cantilevered relation therefrom at a respective one of the opposite sides of the bench assembly adjacent to the one end thereof. The support arms adapted to support a barbell extending between the support arms and across and above the platform of the bench assembly and across the chest region of the weight lifter reclining on the platform with the platform at the first position.

When the platform height adjusting mechanism of the bench assembly is unlatched to permit the platform to move from the first position to the second position the chest region of the weight lifter reclining on the platform is moved away from the barbell so as to provide sufficient clearance between the barbell and the weight lifter to allow the weight lifter to slide out from under the barbell and off the platform.

Further, the present invention is directed to a stand assembly for a preacher-curl weight workout station which comprises: (a) an elongated base stationarily disposable on a support surface; (b) a support post attached on the base so as to extend upright therefrom; (c) an elongated arm having spaced inner and outer ends; (d) means for mounting the arm above the base and at said inner end of the arm to the support post to undergo pivotal movement about an axis extending in a transverse relation to the support post, the arm extending outwardly in cantilevered fashion from the support post to the outer end of the arm; (e) a shelf attached on the outer end of the arm for holding a barbell; and (f) a height adjusting mechanism connected to and extending between the arm and one of the base and the support post and being latchable to hold the arm at a first position relative to the base in which the shelf is disposed at a starting weight rest position, unlatchable to release the arm and permit the arm to undergo pivotal movement from the first position to a second position and thereby move the shelf from the starting weight rest position to a finishing weight rest position higher than the starting position, and latchable to hold the platform at the second position and thereby dispose the shelf at the finishing position.

Still further, the present invention is directed to a preacher-curl weight workout station which comprises the above-defined stand assembly, an arm and chest positioning assembly mounted on an upper end of the support post, and a seat assembly attached to and extending outwardly in cantilevered fashion from a side of the support post. The elongated arm is pivotally mounted and extends from the opposite side of the support post.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the following detailed description, reference will be made to the attached drawings in which.

DETAILED DESCRIPTION OF THE INVENTION

Bench-Press Weight Workout Station

Figure 1:
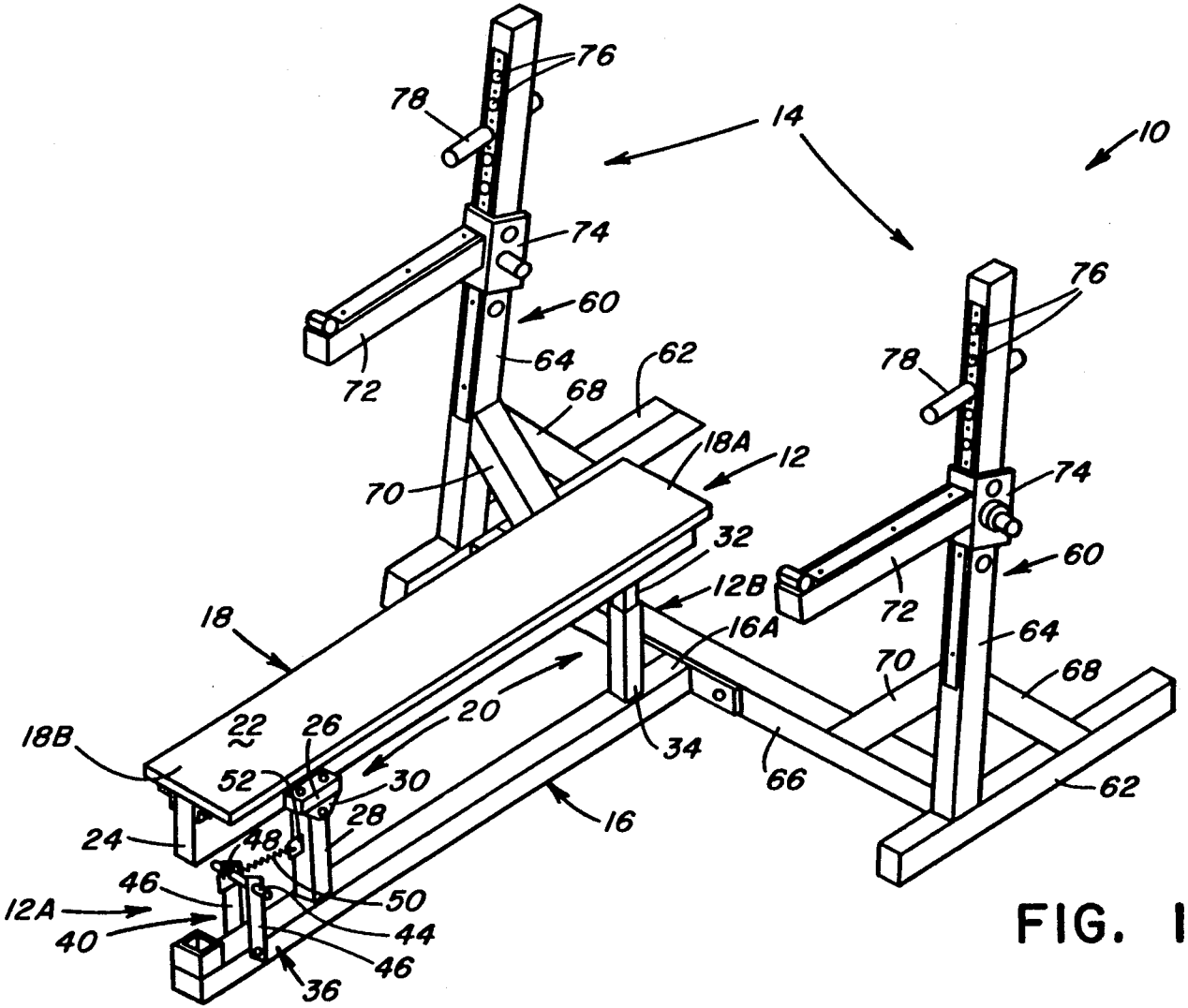
FIG. 1 is a side perspective view of a bench-press weight workout station incorporating an improved safety feature in accordance with the present invention.

Referring to the drawings, and particularly to FIG. 1, there is illustrated a bench-press weight workout station, generally designated 10, incorporating an improved safety feature in accordance with the present invention. The bench-press weight workout station 10 basically includes a bench assembly, generally designated 12, and a weight support rack assembly, generally designated 14. As will become clear below, the bench assembly 12 incorporates the improved safety feature of the bench-press workout station 10.

Figure 2:
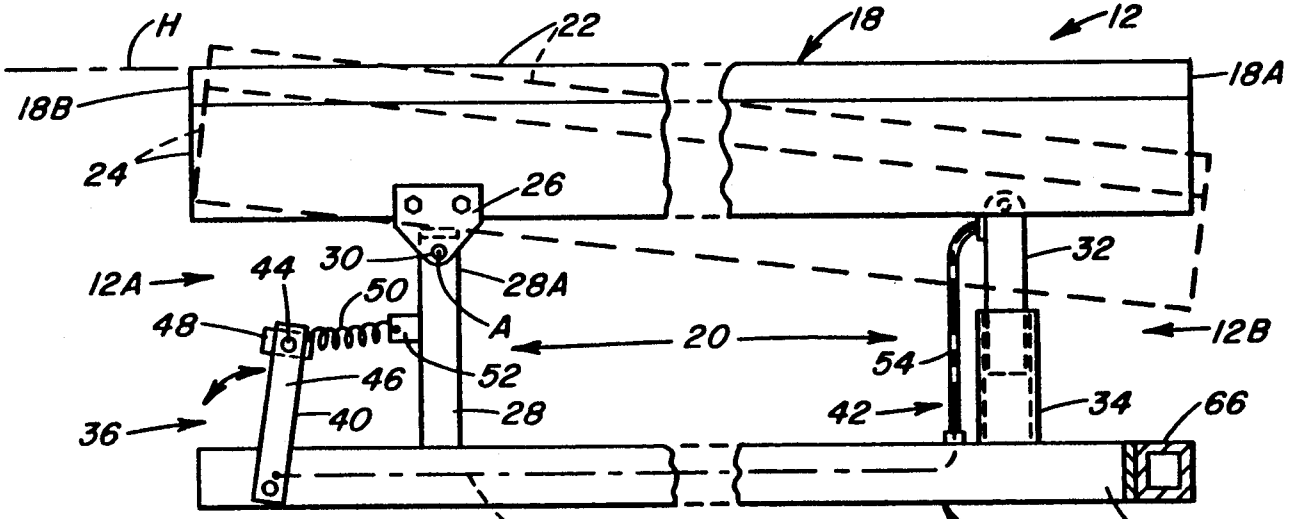
FIG. 2 is an enlarged fragmentary side elevational view of a pivotal bench of the weight workout station of FIG. 1 which constitutes a portion of the safety feature incorporated by the station.

Referring to FIGS. 1 and 2, the bench assembly 12 of the station 10 basically includes an elongated base 16, an elongated platform 18, and means 20 for mounting the platform 18 above the base 16. The base 16 of the bench assembly 12 is in the form of a hollow tubular beam of rectangular cross-section capable of stationary placement on a support surface, such as a floor. The platform 18 of the bench assembly 12 is in the form of an elongated padded board 22 and a rail 24 extending along and attached to the underside of the board 22.

Components making up the platform mounting means 20 of the bench assembly 12 support the platform 18 above the base 16. Near a foot end 12A of the bench assembly 12, components of the platform mounting means 20 includes a pair of spaced flanges 26 attached to opposite sides of the rail 24 and protruding downwardly therefrom beyond the bottom thereof, and a tubular support member 28 rigidly attached to the base 16 and extending upwardly therefrom to an upper end 28A disposed between the spaced flanges 26. A final component of the platform mounting means 20 located near the foot end 12A of the bench assembly 12 is a coupling element 30 inserted through aligned holes in the flanges 26 and a hole in the upper end 28A of the support member 28 which defines a transverse axis A and connects the upper end 28A of the support member 28 to the spaced flanges 26 for pivoting of the platform 18 relative to the base 16 about the transverse axis A.

Adjacent to a head end 12B of the bench assembly 12, components of the platform mounting means 20 includes an upper hollow tubular member 32 pivotally attached to and extending downwardly from the rail 24 of the platform 18, and a lower hollow tubular member 34 attached to and extending upwardly from the base 16 in alignment with the upper tubular member 32. The hollow lower tubular member 34 receives the hollow upper tubular member 32 in a manner which permits reciprocal movement of the upper tubular member 32 relative to the lower tubular member 34 upon pivotal movement of the platform 18 relative to the base 16.

The above-described components of the platform mounting means 20 of the bench assembly 12 makes the platform 18 capable of undergoing reciprocal movement at the one head end 18A of the platform 18 toward and away from the base 16 and of undergoing pivotal movement at an opposite foot end 18B of the platform 18 about the transverse axis A and relative to the base 16 which allows raising and lowering of the one head end 18A of the platform 18 relative to the base 16. Such raising and lowering permits the changing of the platform 18 between a first position, as seen in solid line form in FIG. 2, and a second position, as seen in dashed line form in FIG. 2. The one head end 18A of the platform 18 is lower when the platform 18 is at the second position than when at the first position. When at the first position, the platform 18 is disposed nearer to a horizontal reference plane H than when it is at the second position. In other words, the platform 18 at the first position is disposed at a first angle to a horizontal reference plane H (which can be zero if the platform 18 is aligned with the plane H), whereas the platform 18 at the second position is disposed at a second angle, such as between ten to twenty degrees, to the horizontal reference plane H being greater than the first angle.

Figure 3:
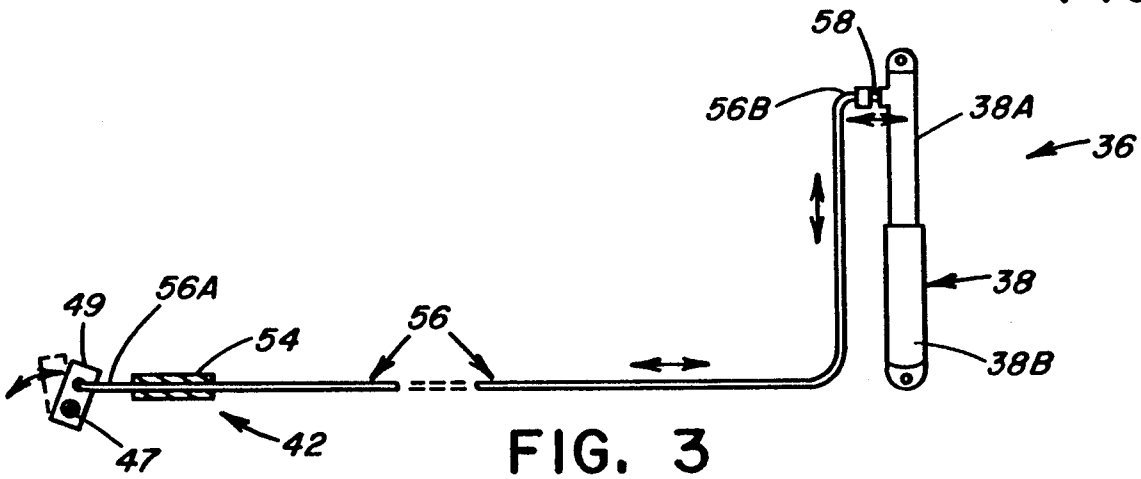
FIG. 3 is a diagrammatic view of a bench height adjusting mechanism of the weight workout station of FIG. 1 which constitutes the rest of the safety feature incorporated by the station.

Referring to FIGS. 1 and 3, the bench assembly 12 of the station 10 also includes a platform height adjusting mechanism 36. The platform height adjusting mechanism 36 includes an extendible and retractible actuator 38, an actuating lever 40, and an elongated inelastic flexible member 42 interconnecting the actuator 38 and the lever 40. The actuator 38 is housed within the upper and lower hollow tubular members 32, 34 and is attached in any suitable manner to and extends vertically between the upper end of the upper tubular member 32 and lower end of the lower tubular member 34.

Preferably, the actuator 38 of the platform height adjusting mechanism 36 is a pneumatic actuating cylinder having telescoping parts 38A, 38B defining a sealed pressurized internal chamber which varies in size and in pressure per square inch as the parts reciprocally move relative to one another. One suitable commercially-available pneumatic gas cylinder which can be used as the actuator 38 is the one designated by Model No. 3925533440 and distributed by Gas Spring Company located in Colmar Pa. In view that the pneumatic cylinder actuator 38 has a well-known construction and functions in a well-known manner, it need not be described in detail herein. Briefly, the pneumatic cylinder actuator 38 can be unlatched so as to release its telescoping parts 38A, 38B from one another and permit them to undergo reciprocal movement in a telescoping fashion relative to one another and thereby permit the platform 18 to undergo pivotal movement between the first and second positions. Further, the pneumatic cylinder actuator 38 can be latched so as to lock its telescoping parts 38A, 38B together and hold them stationary relative to one another in any displaced relationship in which they have been placed relative to one another and thereby hold the platform 18 at either the first or second position or any intermediate position between them.

The actuating lever 40 of the platform height adjusting mechanism 36 is pivotally mounted to the base 16 at the foot end 12A of the bench assembly 12 for pivotal movement between a rearward latching position, as shown in solid line form in FIG. 3, and a forward unlatching position, as shown in dashed line form in FIG. 3. The lever 40 is made up of an upper shaft 44 and a pair of spaced flat strips 46 rigidly attached at upper ends to the upper shaft 44, and a lower shaft 47 rotatably mounted to the base 16. The strips 46 at their lower ends are rigidly attached to the opposite ends of the rotatable lower shaft 47 at opposite sides of the base 16. The actuating lever 40 also includes an upper tab 48 attached to and projecting from the upper shaft 44 between the strips 46, and a lower tab 49 attached to and projecting from the rotatable lower shaft 47. A stretchible spring 50 is connected to and extends between the upper tab 48 and a bracket 52 attached on the tubular support member 28. The lever 40 is pivoted to its forward unlatching position by a weight lifter lying on the platform 18 using either one of his or her feet to push in a forward direction against either opposite end of the upper shaft 44 of the lever 40. Such action stretches the spring 50 so that when the lifter's foot is removed from engagement with the lever 40, the spring 50 will automatically contract and cause the lever 40 to pivotally return to its rearward latching position.

The elongated inelastic flexible member 42 of the platform height adjusting mechanism 36 can take the form of an elongated hollow tubular sheath 54 and an elongated cable 56 slidably mounted within a hollow tubular sheath 54. Both the sheath 54 and cable 56 are composed of a suitable material and are inelastic and flexible in character. The sheath 54 and cable 56 of the inelastic flexible member 42 extends along and through the interior of the hollow base 16 between the lower tab 49 of the actuating lever 40 and the actuator 38. The sheath 54 is stationarily attached to the base 16 by any suitable fastening means. The cable 56 is connected at its front end 56A to the lower tab 49 on the rotatable lower shaft 47 and at its rear end 56B to an actuating button 58 on the actuator 38.

Pivotal movement of the lower tab 49 between its rearward latching position, as shown in solid line form in FIG. 3, and its forward unlatching position, as shown in dashed line form in FIG. 3, causes sliding movement of the cable 56 relative to the sheath 54. The cable 56 transmits motion in a forward direction upon pivoting of the lever 38 from its rearward latching to forward unlatching position. Such forward motion of the cable 56 causes pulling out of the actuating button 58 and thereby unlatching of the actuator 38. With the actuator 38 unlatched, the platform 18 is released and permitted to undergo pivotal movement from the higher first position to the lower second position due to the weight of the lifter on the platform 18 which can override the force of the air pressure in the actuator 38. Also, with the actuator 38 unlatched and after the weight lifter has gotten off the platform 18, the platform 18 will pivotally move automatically from the lower second position back to the higher first position due to the force of the compressed air within the actuator 38.

On the other hand, the cable 56 transmits motion in a rearward direction upon pivoting of the lower tab 49 from its forward unlatching to rearward latching position. Such rearward motion of the cable 56 causes reverse pushing in of the actuating button 58 and thereby latching of the actuator 38. Latching of the actuator 38 holds the platform 18 at whatever position it had assumed before the latching of the actuator 38 occurred, thereby preventing any further pivoting of the platform 18.

Referring again to FIG. 1, the weight support rack assembly 14 of the bench-press station 10 is disposed adjacent to the head end 12B of the bench assembly 12. The weight support rack assembly 14 has a pair of weight support standards 60 disposed at respective opposite sides of the bench assembly 12 adjacent to the head end 12B thereof. Each weight support standard 60 has a base member 62 capable of stationary placement on a support surface, such as a floor, and a support member 64 rigidly mounted on the base member 62 and extending in a generally upright (but slightly backwardly tilted) relation to the base member 62. The weight support rack assembly 14 also includes a stabilizing member 66 extending transversely to the bench assembly 12 between the base members 62 of the support standards 60. At its opposite ends, the transverse stabilizing member 66 is fixedly attached to the base members 62. Also, at its middle portion, the transverse stabilizing member 66 is fixedly attached to the head end 16A of the base 16 of the bench assembly 12. A pair of reinforcing braces 68, 70 are provided in inclined relation between and rigidly attached with the weight support member 64 and base member 62 of each weight support standard 60 and with each opposite end portion of the transverse stabilizing member 66 and the upright support member 64 of each weight support standard 60.

The support rack assembly 14 further includes a pair of support arms 72 respectively slidably mounted along the upright support members 64 of the support standards 60. The support arms 72 are movable to any vertical position along the support members 64 by adjusting respective clamps 74 attached to the rear ends of the support arms 72 which slidably mount the support arms 72 along the upright support members 64. The support arms 72 extend from the upright support members 64 in generally transverse cantilevered relation therefrom along respective opposite sides of the bench assembly 12 adjacent to the head end 12A thereof. The support members 64 also have a plurality of vertically spaced mounting holes 76 defined therethrough and removably receiving a pair of elongated cylindrical pegs 78 at the elevation of any horizontally aligned pair of the holes 76. The pegs 78 are adapted to store a barbell (not shown) extending between them above the bench assembly 12.

The support arms 72 are adapted to support a barbell extending between them and across and above the platform 18 of the bench assembly 12 and across the chest region of a weight lifter reclining on the platform 18 with the bench 18 held at a first weight lifting position by the platform height adjusting mechanism 36 of the bench assembly 12. When the platform height adjusting mechanism 36 is operated by a weight lifter using his or her foot to pivot the actuating lever 40 from its rearward latching to forward unlatching position, the platform 18 is released and permitted to move from its higher first position to its lower second position. Due to such movement of the platform 18 of the bench assembly 12, the chest region of the weight lifter reclining on the platform 18 is moved away from the barbell when held by the support arms 72 so as to provide sufficient clearance between the barbell and the weight lifter to allow the weight lifter to slide out from under the barbell and off the platform 18 and avoid injury.

In conclusion, the safety feature in the bench-press workout station 10 is the platform height adjusting mechanism 36 in the bench assembly 12. As described above, the platform height adjusting mechanism 36 is operable to permit the head end 18A of the platform 18 to undergo pivotal movement from the upper first position to the lower second position to where the body of the weight lifter is clear of the barbell so that the weight lifter can slide out from under the barbell and off the platform 18 at the end of a bench-press workout session. Because of the presence of this safety feature, the weight lifter does not have to return the barbell to the upper pegs 78 at the end of the workout session nor need the assistance of others when the weight lifter has very little energy left in reserve. Instead, the weight lifter can leave the barbell resting across the lower support arms 72 and actuate the platform 18 from its first to second position in order to slide out from under the barbell and off the platform 18 at the end of the workout session.

Preacher-Curl Weight Workout Station

Figure 4:
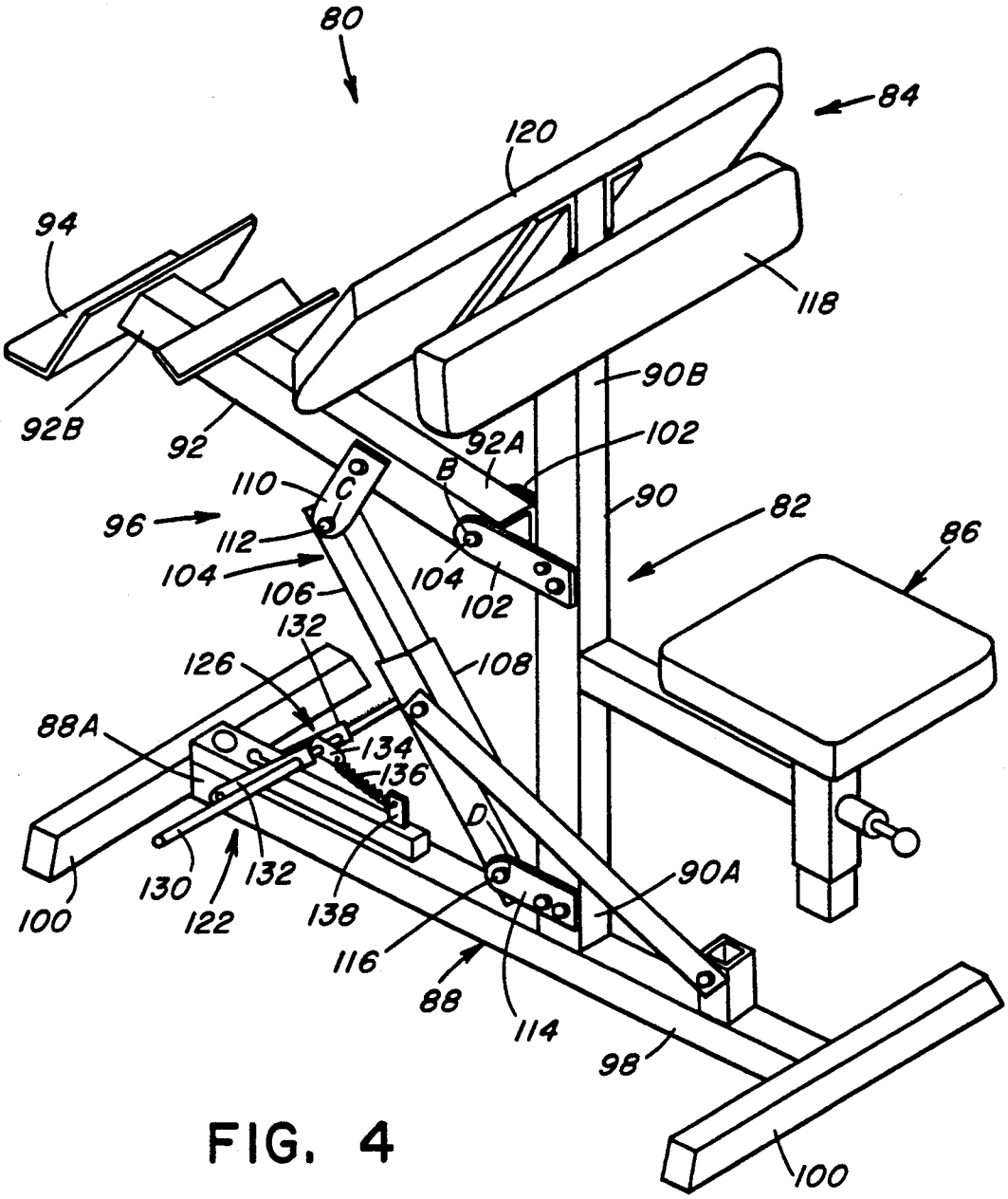
FIG. 4 is a side perspective view of a preacher-curl weight workout station incorporating another improved safety feature in accordance with the present invention.

Referring to FIG. 4, there is illustrated a preacher-curl weight workout station, generally designated 80, incorporating another improved safety feature in accordance with the present invention. The preacher-curl weight workout station 80 basically includes a stand assembly, generally designated 82, an arm and chest positioning assembly 84, and a seat assembly 86. As will become clear below, the stand assembly 82 incorporates the improved safety feature of the preacher-curl workout station 80.

Basically, the stand assembly 82 of the preacher-curl station 80 includes an elongated base 88, a support post 90, an elongated arm 92, a shelf 94, and arm mounting means 96. The base 88 of the stand assembly 82 is made up of a long hollow tubular beam 98 and a pair of short hollow tubular beams 100 rigidly attached to the opposite ends of the long beam 98 and extending in transverse relation thereto. The long beam 98 and short beams 100 are rectangular in cross-section and provide a rigid structure having an I-shaped configuration capable of stationary placement on a support surface, such as a floor.

The support post 90 of the stand assembly 82 is rigidly attached upright on the long beam 98 of the base 88 about midway between the opposite ends of the long beam 90. The upright support post 90 has the form of a hollow tubular beam with a rectangular cross-sectional shape. The elongated arm 92 has opposite inner and outer ends 92A, 92B. The means 96 for mounting the arm 92 above the base 88 includes a pair of upper plates 102 rigidly attached to opposite lateral sides of the support post 90. The upper plates 102 project forwardly past the forward side of the support post 90. The inner end 92A of the arm 92 fits between the plates 102 and is pivotally connected thereto by a pin 104 to undergo pivotal movement about an axis B extending in a transverse relation to the support post 90 and defined by the pin 104. The arm 92 extends outwardly in cantilevered fashion from the upright support post 90. The shelf 94 is fixedly attached on the outer end 92B of the arm 92 and has a V-shaped configuration for holding a barbell (not shown).

The stand assembly 82 also includes means 104 for supporting the arm 92 from either the base 88 and support post 90. The illustrated embodiment, the components of the arm supporting means 104 support the arm 92 from a location on the lower end 90A of the support post 90 immediately above the base 88. More particularly, the components of the arm supporting means 104 includes an upper hollow tubular member 106 and a lower hollow tubular member 108 receiving the upper tubular member 106 in a manner which permits reciprocal sliding movement of the upper tubular member 106 relative to the lower tubular member 108. The components of the arm supporting means 104 also include a pair of links 110 fixed on the opposite sides of the arm 92 at locations spaced from the inner end 92A of the arm. The links 110 project downwardly from the arm 92. An upper coupling pin 112 pivotally connects an upper end of the upper tubular member 106 between the links 110. The components of the arm supporting means 104 further include a pair of lower plates 114 spaced below the upper plates 102 and located at a lower end 90A of the upright support post 90 immediately above the base 88. The lower plates 114 are rigidly attached to the opposite lateral sides of the upright support post 90 and project forwardly from the front side therefrom. A lower coupling pin 116 pivotally connects a lower end of the lower tubular member 108 between the lower plates 114.

The above-described components of the arm supporting means 104 of the stand assembly 82 permit the upper and lower tubular members 106, 108 to pivot about respective upper and lower axes C, D defined by the upper and lower coupling pins 112, 116 (and extending generally parallel to the transverse pivotal axis B of the arm 92) and relative to the arm 92 and upright support post 90 as the upper tubular member 106 undergoes sliding reciprocal movement relative to the lower tubular members 108. Such pivotal and reciprocal movement of the upper and lower tubular members 106, 108 allows the elongated arm 92 to pivot about the transverse axis B relative to the upright support post 90 between first and second positions and raise and lower the shelf 94 on the outer end 92B of the arm 92 away from and toward the base 88 of the stand assembly 82 between a starting weight rest position, as seen in solid line form in FIG. 5, and a finishing weight rest position, as seen in dashed line form in FIG. 5. When at the starting position, the shelf 94 is disposed at an elevation above the base 94 which is closer to the base 88 and lower than the shelf 94 at the finishing position.

Referring again to FIG. 4, the lifter arm and chest positioning assembly 84 is mounted on an upper end 90B of the upright support post 90. The seat assembly 86 is rigidly attached to and extends outwardly in cantilevered fashion from the rear side of the upright support post 90 just below the location of the upper plates 102 and in an opposite direction from the support post 90 compared to that of the arm 92. When seated on the seat assembly 86 in position to perform preacher-curl weight lifts, the weight lifter's chest is disposed against a vertical member 118 and arms rest over a forwardly and downwardly inclined member 120 of the arm and chest positioning assembly 84.

Figure 5:
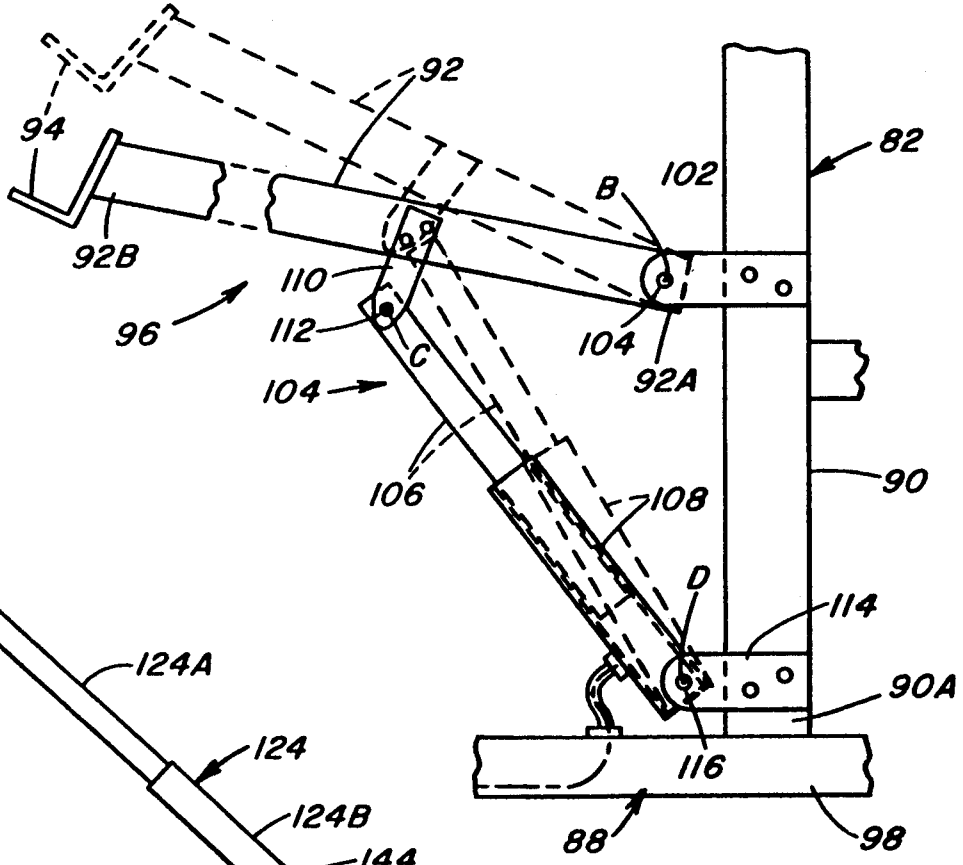
FIG. 5 is an enlarged fragmentary side elevational view of a pivotal arm of the weight workout station of FIG. 4 which constitutes a portion of the safety feature incorporated by the station.
Figure 6:
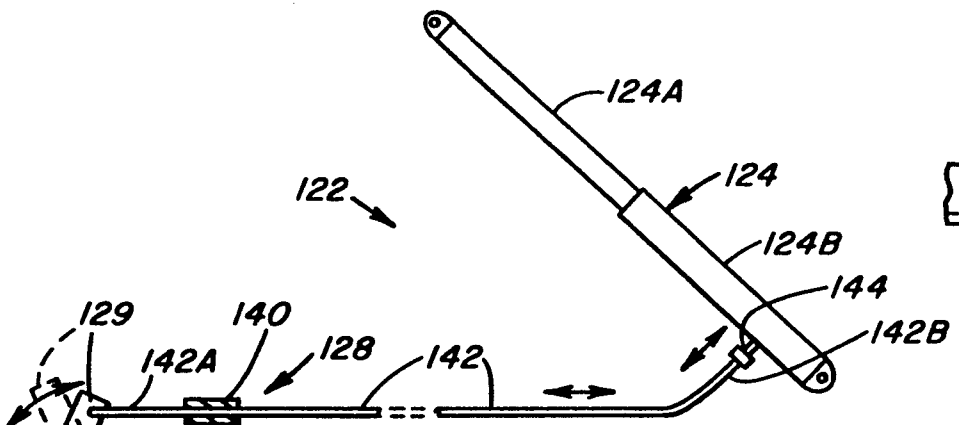
FIG. 6 is a diagrammatic view of a arm height adjusting mechanism of the weight workout station of FIG. 4 which constitutes the rest of the safety feature incorporated by the station.

Referring to FIGS. 4–6, the stand assembly 82 of the station 80 also includes an arm height adjusting mechanism 122 connected to and extending between the elongated arm 92 and one of the base 88 and the upright support post 90 and, in the illustrated embodiment, from the support post 90. The arm height adjusting mechanism 122 includes an extendible and retractible actuator 124, an actuating lever 126, and an elongated inelastic flexible member 128 interconnecting the actuator 124 and the lever 126. The actuator 124 is housed within the upper and lower hollow tubular members 106, 108 and is attached to and extends vertically between the upper end of the upper tubular member 106 and lower end of the lower tubular member 106.

Preferably, the actuator 124 of the arm height adjusting mechanism 122 is a pneumatic actuating cylinder having telescoping parts 124A, 124B defining a sealed pressurized internal chamber which varies in size and in pressure per square inch as the parts reciprocally move relative to one another. One suitable commercially-available pneumatic cylinder which can be used as the actuator 124 is the same as the one identified earlier which can be employed for the actuator 38 of the bench assembly 12. The pneumatic cylinder actuator 124 can be unlatched so as to release its telescoping parts 124A, 124B from one another and permit them to undergo reciprocal movement in a telescoping fashion relative to one another and thereby permit the elongated arm 92 to undergo pivotal movement between the first and second positions. Further, the pneumatic cylinder actuator 124 can be latched so as to lock its telescoping parts 124A, 124B together and hold them stationary relative to one another in any displaced relationship in which they have been placed relative to one another and thereby hold the elongated arm 92 at either the first or second position or any intermediate position between them.

The actuating lever 126 of the arm height adjusting mechanism 122 is pivotally mounted to the base 88 by a rotatable lower shaft 127 disposed at the foot end 88A thereof. The lever 126 includes a lower tab 129 rigidly attached on the rotatable lower shaft 127 and disposed inside of the base 88 for pivotal movement between a rearward latching position, as shown in solid line form in FIG. 6, and a forward unlatching position, as shown in dashed line form in FIG. 6. The lever 126 is also made up of an elongated upper shaft 130 and a pair of spaced flat strips 132. The strips 132 are rigidly connected at lower ends to opposite ends of the rotatable lower shaft 127 along opposite sides of the long beam 98 of the base 88 and rigidly attached at upper ends to the upper shaft 130. The actuating lever 126 also includes an upper tab 134 attached to and projecting from the shaft 130 between the strips 132. A stretchible spring 136 is connected to and extends between the upper tab 134 and a bracket 138 attached on the long beam 98 of the base 88. The lever 126 is pivoted to its forward unlatching position by a weight lifter seated on the seat assembly 86 using either one of his or her feet to push in a forward direction against either opposite end of the shaft 130 of the lever 126. Such action stretches the spring 136 so that when the lifter's foot is removed from engagement with the lever 126, the spring 136 will automatically contract and cause the lever 126 to pivotally return to its rearward latching position.

The elongated inelastic flexible member 128 of the arm height adjusting mechanism 122 can take the form of an elongated hollow tubular sheath 140 and an elongated cable 142 slidably mounted within a hollow tubular sheath 140. Both the sheath 140 and cable 142 are composed of a suitable material and are inelastic and flexible in character. The sheath 140 and cable 142 of the inelastic flexible member 128 extends along and through the interior of the hollow long beam 98 of the base 88 and into the lower end 90A of the upright support post 90 between the actuating lever 126 and the actuator 124. The sheath 140 is stationarily attached to the base 88 and support post 90 by any suitable fastening means. The cable 142 is connected at its front end 142A to the lower tab 129 on the rotatable lower shaft 127 and at its rear end 142B to an actuating button 144 of the actuator 124.

Pivotal movement of the lower tab 129 (and lever strips 132) between its rearward latching position, as shown in solid line form in FIG. 6, and its forward unlatching position, as shown in dashed line form in FIG. 6, causes sliding movement of the cable 142 relative to the sheath 140. The cable 142 transmits motion in a forward direction upon pivoting of the lower tab 129 from its rearward latching to forward unlatching position. Such forward motion of the cable 142 causes pulling out of the actuating button 144 and thereby unlatching of the actuator 124. With the actuator 124 unlatched, the elongated arm 92 is released and permitted to undergo pivotal movement between the lower first position and the higher second position or vice versa. On the other hand, the cable 142 transmits motion in a rearward direction upon pivoting of the lever 126 from its forward unlatching to rearward latching position. Such forward motion of the cable 142 causes reverse pushing in of the actuating button 144 and thereby latching of the actuator 124. Latching of the actuator 124 holds the elongated arm 92 at the position it had assumed before the latching of the actuator 124 occurred, thereby preventing any further pivoting of the arm 92.

In conclusion, the safety feature in the stand assembly 82 is the arm height adjusting mechanism 122. As described above, the arm height adjusting mechanism 122 is operable to permit the elongated arm 92 to undergo pivotal movement from the lower position to the upper position and thereby move the shelf 94 from the lower start weight rest position to the upper finish weight rest position being higher than the start position to where the barbell can be more easily placed by the weight lifter at the end of the preacher-curl workout session. Because of the presence of this safety feature, the weight lifter does not have to return the barbell to the shelf 94 at the lower start weight rest position which could cause overtensioning of the elbows and back of the lifter. Instead, the weight lifter can place the barbell across the shelf 94 at the upper finish weight rest position.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A bench assembly for a bench-press weight workout station, comprising:

(a) an elongated base stationarily disposable on a support surface;

(b) an elongated platform;

(c) means for mounting said platform above said base and interconnected to said base to undergo reciprocal movement at one end of said platform toward and away from said base and to undergo pivotal movement at an opposite end of said platform about a transverse axis and relative to said base in order to raise and lower said one end of said platform relative to said base and thereby change said platform between first and second positions, said one end of said platform being lower at said second position of said platform than at said first position thereof, said means for mounting said platform above said base to undergo said reciprocal movement including an upper hollow tubular member pivotally attached to and extending downwardly from said one end of said platform and a lower hollow tubular member attached to and extending upwardly from an end of said base in alignment with said upper tubular member, one of said lower and upper tubular members receiving the other of said lower and upper tubular members therein so as to permit reciprocal movement of said upper tubular member relative to said lower tubular member upon pivotal movement of said platform relative to said base; and (d) a platform height adjusting mechanism connected to and extending between said base and said one end of said platform and being latchable to hold said platform at said first position relative to said base, unlatchable to release said platform and permit said platform to undergo pivotal movement from said first position to said second position, and latchable to hold said platform at said second position, said platform height adjusting mechanism including an extendible and retractible actuator disposed within said upper and lower hollow tubular members and being pivotally attached to and extending vertically between said one end of said platform and an end of the said base aligned with said one end of said platform, said actuator being latchable to hold said platform at said respective first and second positions and unlatchable to release said platform and permit said platform to undergo pivotal movement between said first and second positions.

2. The assembly of claim 1, wherein said platform at said first position is disposed at a first angle to a horizontal reference plane and at said second position is disposed at a second angle to the horizontal reference plane being greater than said first angle.

3. The assembly of claim 1 wherein said means for mounting said platform above said base includes:

a pair of spaced flanges attached to and extending downwardly from said opposite end of said platform;

a support member attached to and extending upwardly from an end of said base aligned with said opposite end of said platform, said support member having an upper end disposed between said spaced flanges; and a pivotal element defining said transverse axis and extending through and pivotally connecting said upper end of said support member to said spaced flanges.

4. The assembly of claim 1 wherein said platform height adjusting mechanism further includes:

a lever pivotally mounted to an opposite end of said base generally aligned with said opposite end of said platform, said lever being pivotable between latching and unlatching positions; and an elongated flexible member extending along said base between said lever and said actuator for transmitting motion in a first direction upon pivoting of said lever from said latching to unlatching position to cause unlatching of said actuator and for transmitting motion in a second opposite direction upon pivoting of said lever from said unlatching to a latching position to cause latching of said actuator.

5. The assembly of claim 4 wherein said base is hollow and said elongated flexible member extends through said hollow base.

6. A bench-press weight workout station, comprising:

(a) a bench assembly including an elongated base stationarily disposed on a support surface and an elongated platform disposed above said base, said platform having a pair of opposite ends and being capable of supporting a weight lifter lying thereon with the weight lifter facing upwardly and the weight lifter's head being located at one of said ends of said platform and feet being located adjacent to the other of said ends of said platform, said bench assembly also including means for mounting said platform adjacent to said one end thereof to said base for undergoing reciprocal movement toward and away from said base and for mounting said platform adjacent to said other end thereof to said base for undergoing pivotal movement relative to said base to raise and lower said one end of said platform relative to said base and thereby change said platform between a first position disposed at a first angle to a horizontal plane and a second position disposed at a second angle to the horizontal plane being greater than said first angle and with said one end of said platform being lower at said second position of said platform than at said first position thereof, said means for mounting said platform above said base to undergo said reciprocal movement including an upper hollow tubular member pivotally attached to and extending downwardly from said one end of said platform and a lower hollow tubular member attached to and extending upwardly from an end of said base in alignment with said upper tubular member, one of said lower and upper tubular members receiving the other of said lower and upper tubular members therein so as to permit reciprocal movement of said upper tubular member relative to said lower tubular member upon pivotal movement of said platform relative to said base;

(b) a support rack assembly disposed adjacent to said one end of said platform of said bench assembly, said support rack assembly having a pair of support members each extending in an generally upright relation to said bench assembly and being disposed at one of a pair of opposite sides of said bench assembly adjacent to said one end of said platform and a pair of support arms each mounted at one end to one of said upright support members and extending in a generally transverse cantilevered relation therefrom at a respective one of said opposite sides of said bench assembly adjacent to said one end of said platform, said support arms being adapted to support a barbell extending between said support arms and across and above said platform of said bench assembly and across the chest region of the weight lifter reclining on said platform with said platform at said first position; and (c) a platform height adjusting mechanism connected to and extending between said base and said one end of said platform of said bench assembly and being latchable to hold said platform at said first position relative to said base, unlatchable to release said platform and permit said platform to undergo pivotal movement from said first position to said second position, and latchable to hold said platform at said second position in which the chest region of the weight lifter is spaced below the barbell so as to provide sufficient clearance to permit the weight lifter to slide out from under the barbell and off said platform, said platform height adjusting mechanism including an extendible and retractible actuator disposed within said upper and lower hollow tubular members and being pivotally attached to and extending vertically between said one end of said platform and an end of said base aligned with said one end of said platform, said actuator being latchable to hold said platform at said respective first and second positions and unlatchable to release said platform and permit said platform to undergo pivotal movement between said first and second positions.

7. The station of claim 6 wherein:

said support rack assembly includes a transverse member attached to and interconnecting said support members; and said base being attached at one end to said transverse member.

8. The station of claim 6 wherein said bench assembly also has means for mounting said platform above said base which includes:

a pair of flanges spaced apart, attached to and extending downwardly from said opposite end of said platform;

a support member attached to and extending upwardly from an end of said base aligned with said opposite end of said platform, said support member having an upper end disposed between said spaced flanges; and a pivotal element defining said transverse axis and extending through and pivotally connecting said upper end of said support member to said spaced flanges.

9. The station of claim 6 wherein said platform height adjusting mechanism further include:

a lever pivotally mounted to an opposite end of said base generally aligned with said opposite end of said platform, said lever being pivotable between latching and unlatching positions; and an elongated flexible member extending along said base between said lever and said actuator for transmitting motion in a first direction upon pivoting of said lever from said latching to unlatching position to cause unlatching of said actuator and for transmitting motion in a second opposite direction upon pivoting of said lever from said unlatching to latching position to cause latching of said actuator.

10. The station of claim 9 wherein said base is hollow and said elongated flexible member extends through said hollow base.

* * * * *